US007406956B2

(12) United States Patent
Fujii

(10) Patent No.: US 7,406,956 B2
(45) Date of Patent: Aug. 5, 2008

(54) DEVICE FOR ENHANCING COMBUSTION EFFICIENCY

(76) Inventor: Kenji Fujii, 877-6 Tenno-cho, Hamamatsu-City, Shizuoka (JP)

( * ) Notice: Subject to any disclaimer, the term of this patent is extended or adjusted under 35 U.S.C. 154(b) by 519 days.

(21) Appl. No.: 10/551,708

(22) PCT Filed: Aug. 3, 2005

(86) PCT No.: PCT/JP2005/014191

§ 371 (c)(1),
(2), (4) Date: Oct. 3, 2005

(87) PCT Pub. No.: WO2007/015295

PCT Pub. Date: Feb. 8, 2007

(65) Prior Publication Data

US 2008/0098996 A1 May 1, 2008

(51) Int. Cl.
*F02M 33/00* (2006.01)

(52) U.S. Cl. ..... 123/538

(58) Field of Classification Search ..... 123/536–538
See application file for complete search history.

(56) References Cited

U.S. PATENT DOCUMENTS

| | | | | |
|---|---|---|---|---|
| 5,524,594 | A * | 6/1996 | D'Alessandro | 123/538 |
| 5,580,359 | A * | 12/1996 | Wright | 44/321 |
| 6,024,073 | A * | 2/2000 | Butt | 123/538 |
| 7,021,297 | B1 * | 4/2006 | Slingo | 123/536 |
| 7,100,583 | B2 * | 9/2006 | Lu | 123/536 |
| 2004/0056208 | A1 * | 3/2004 | Slingo | 250/432 R |

* cited by examiner

*Primary Examiner*—M. Mcmahon
(74) *Attorney, Agent, or Firm*—Jordan and Hamburg LLP

(57) ABSTRACT

The fossil fuel supplied into the engine and combustion device passes through the fuel-enhancing unit of the enhancing device of the present invention with the burned object generating far-infrared radiation and negative ion. Therefore, it can be attained complete combustion; it can improve fuel consumption; and emission gas including nitrogen oxide, particulate, carbon monoxide, hydrocarbon and carbon dioxide and black smoke can be reduced.

2 Claims, 13 Drawing Sheets

DEVICE FOR ENHANCING COMBUSTION EFFICIENCY

FIELD OF THE INVENTION

The present invention relates to a device for enhancing combustion efficiency of the fossil fuel which is supplied into the engine and combustion device and which can reduce the emission gas and black smoke, and the device is provided at a fuel-supply pipe.

BACKGROUND OF THE INVENTION

In the conventional way, as the method for enhancing the fuel of the engine of the automobile, the fuel-reforming material, which is harden the tourmaline powder, hillite powder and metal powder by plastic, is input into the fuel tank; the fuel-reforming material is stored into the box, and it is provided at the fuel-supply hose; and the magnet is attached to the fuel-supply hose.

However, the liquid fuel supplied into the engine is not improved enough in the above-mentioned ways, and it cannot attain complete combustion.

SUMMARY OF THE INVENTION

Accordingly, it is an object of the present invention to provide a device for enhancing combustion efficiency of the fossil fuel which can attain complete combustion in the engine and combustion device by passing fossil fuel supplied into the engine and combustion device through a fuel-enhancing unit with a burned object generating far-infrared radiation and negative ion. In addition, it is another object of the present invention to provide a device for enhancing combustion efficiency of the fossil fuel which can improve the fuel consumption and reduce emission gas including nitrogen oxide, particulate, carbon monoxide, hydrocarbon and carbon dioxide and black smoke.

The present invention is understood to encompass embodiments which include all or only a portion of the above objects, features and advantages which, unless recited in claims defining the invention, are understood not to limit interpretation of such claims. The above, and other objects, features and advantages of the present invention will become apparent from the following description read in conjunction with the accompanying drawings, in which like reference numerals designate the same elements.

It is to be expressly understood, however, that the drawings are for the purpose of illustration and description only, and are not intended as a definition of the limits of the invention.

DETAILED DESCRIPTION OF THE PREFERRED EMBODIMENTS

Figure 1:
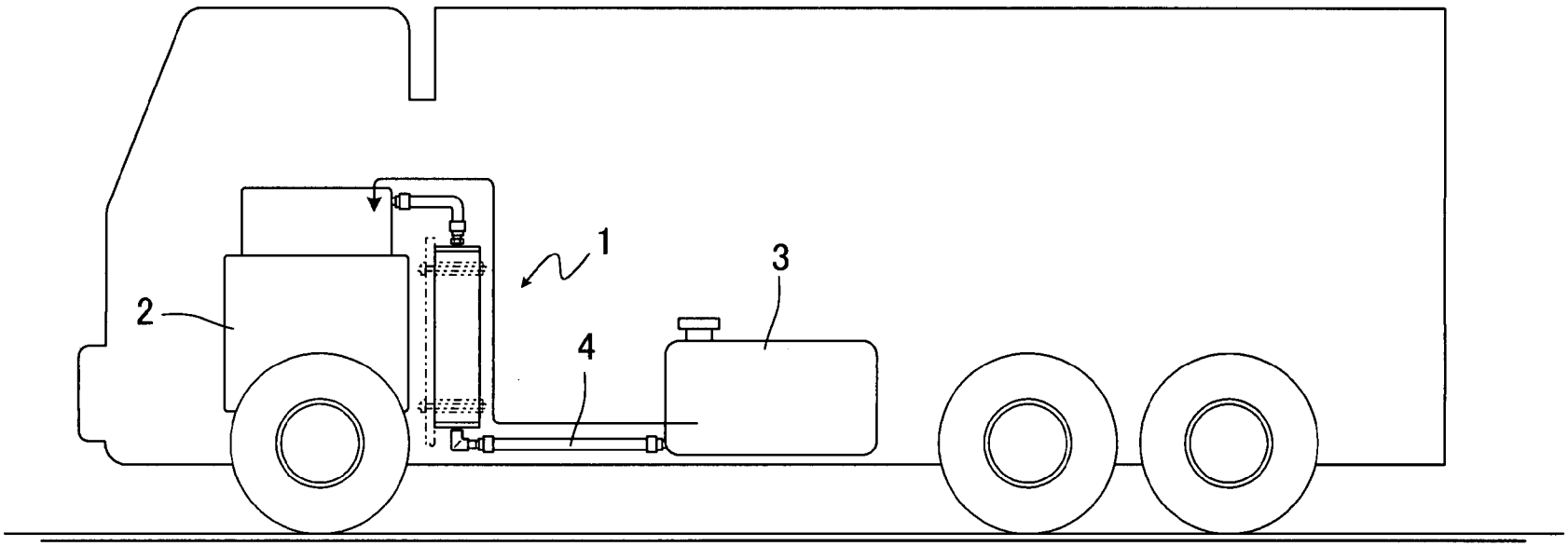
FIG. 1 is an explanation view when in use showing a first embodiment of the present invention.
Figure 2:
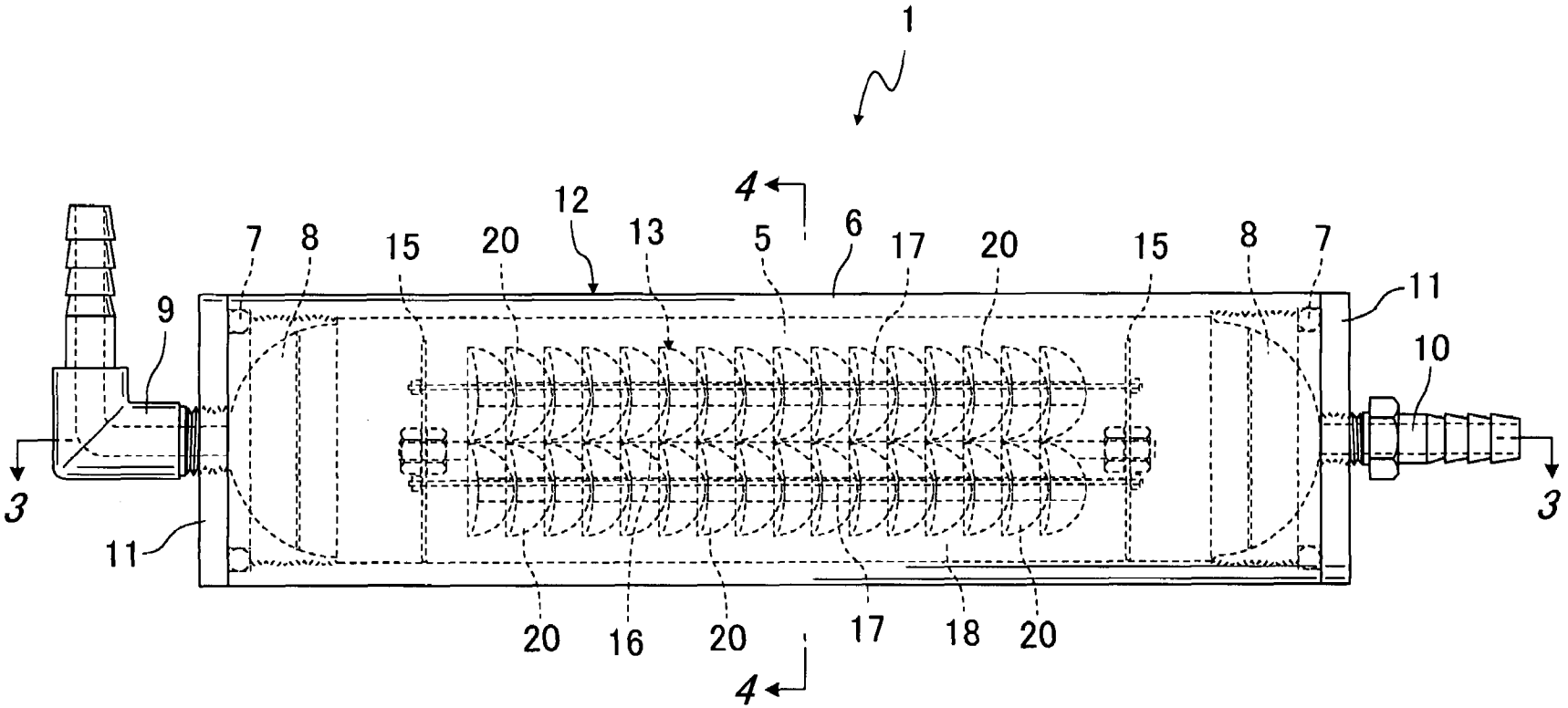
FIG. 2 is a front view showing a first embodiment of the present invention.
Figure 3:
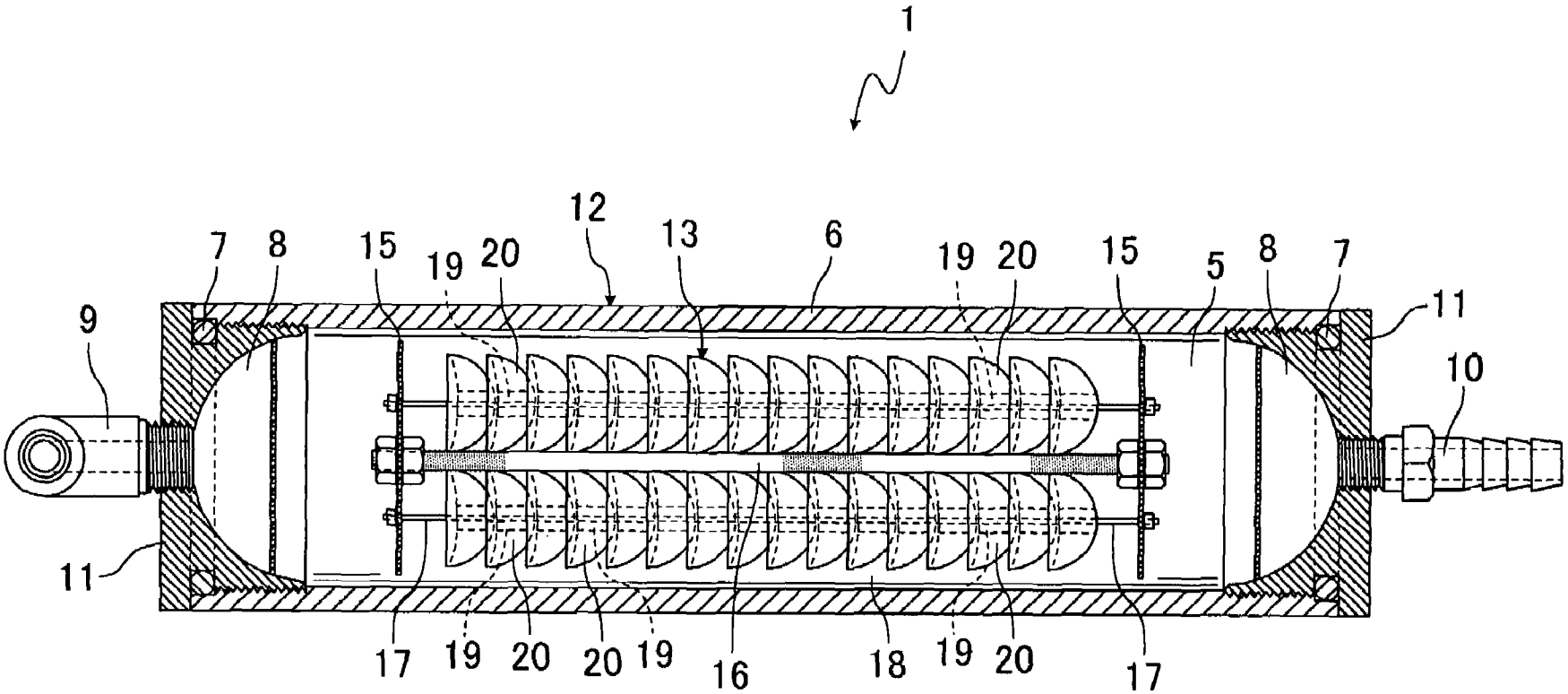
FIG. 3 is a cross sectional view taken along the line 3-3 in FIG. 2.
Figure 4:
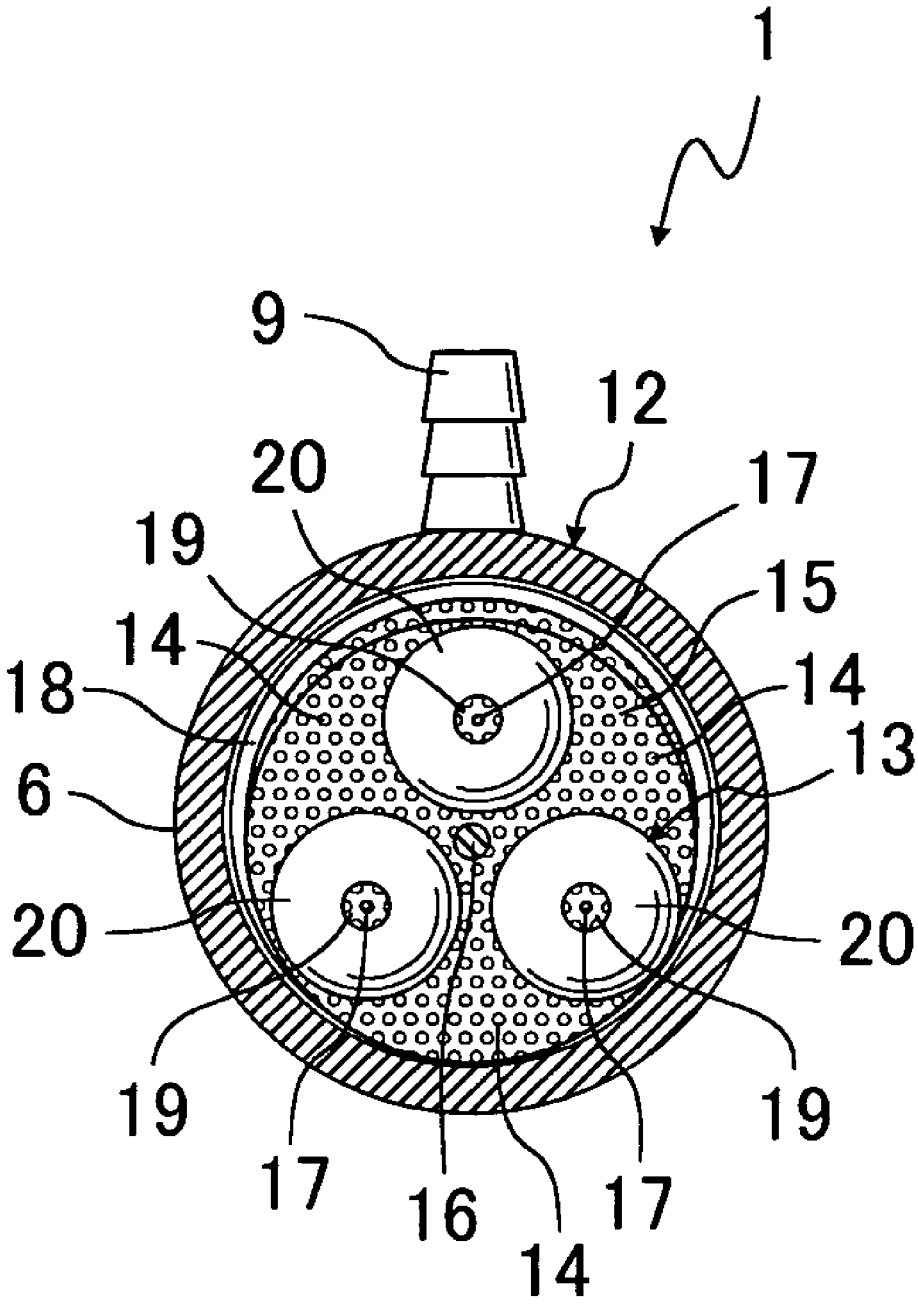
FIG. 4 is a cross sectional view taken along the line 4-4 in FIG. 2.
Figure 5:
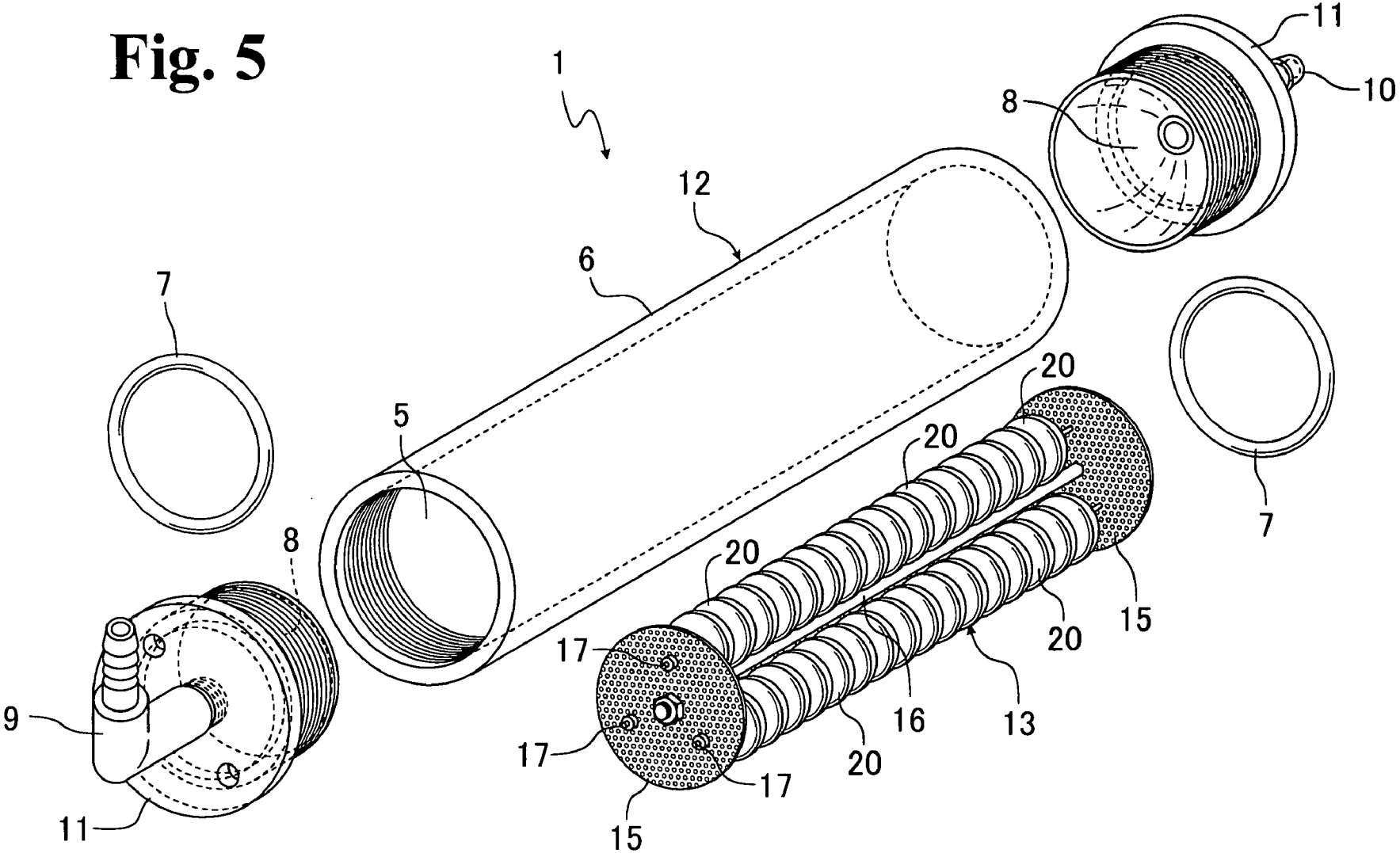
FIG. 5 is an exploded perspective view showing a first embodiment of the present invention.

Preferred embodiments of the present invention are described in more detail below referring to the accompanying drawings.

An understanding of the present invention may be best gained by reference FIGS. 1 to 8. Reference numeral 1 is a device for enhancing combustion efficiency of the fossil fuel, providing at a part, adjacent an engine 2, of a fuel-supply pipe 4 which supplies a liquid fuel including fossil fuel from a fuel tank 3 into the engine 2 of the automobile and capable of enhancing the fuel at an enhancing chamber which generates far-infrared radiation and negative ion. The enhancing device for combustion efficiency is comprised of a case 12 including a case body 6, which is formed in the shape of a cylinder, having an enhancing chamber 5 which has several times the internal diameter of the fuel-supply pipe 4 thereinto, preferably 8 to 10 times of the internal diameter of the fuel-supply pipe 4 and blockage bodies 11, 11 which are screwed fixedly in both ends of the case body 6 at a sealing state through packings 7, 7, attaching jointed pipes 9, 10 for inputting and outputting, which are formed circular arc-shaped concave parts 8, 8 at an inner wall thereof; and a fuel-enhancing unit 13 which is stored movable into the case 12.

The fuel-enhancing unit 13 further includes a pair of supporting plates 15, 15 which are provided at parts adjacent both ends of the enhancing chamber 5 of the case 12, forming a plurality of holes 14 such as punching metal; a supporting body 16 attached both ends thereof to the center portion of the supporting plates; three or four supporting bars, three supporting bars 17, 17, 17 in this embodiment, which are supported both ends thereof by the supporting plates 15, 15 at a predetermined space; a plurality of burned objects 20 which are provided to the supporting bars 17, 17, 17 respectively, generating far-infrared radiation and negative ion, forming in the shape of a crescent moon in section, arranging so as to be a concave part at an inputting side, forming insertion hole 19, with size producing inputting and arranging so as to be positioned at a inputting side thereof.

Figure 6:
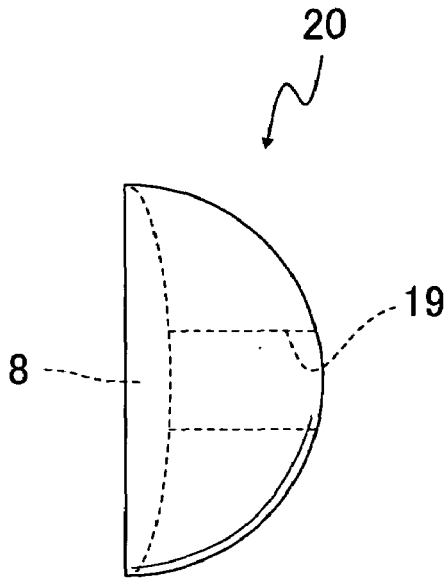
FIG. 6 is a front view of a burned object showing a first embodiment of the present invention.
Figure 7:
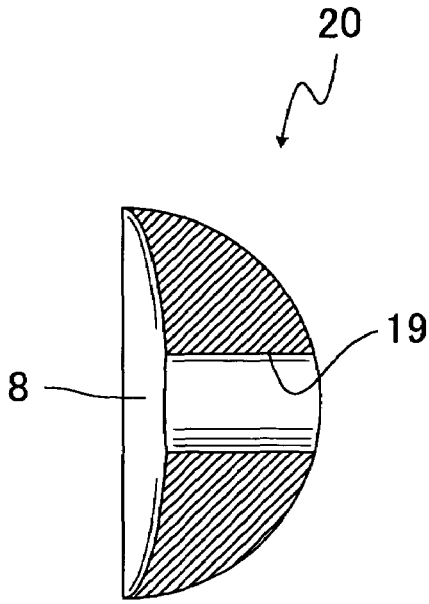
FIG. 7 is a cross sectional view of a burned object showing a first embodiment of the present invention.
Figure 8:
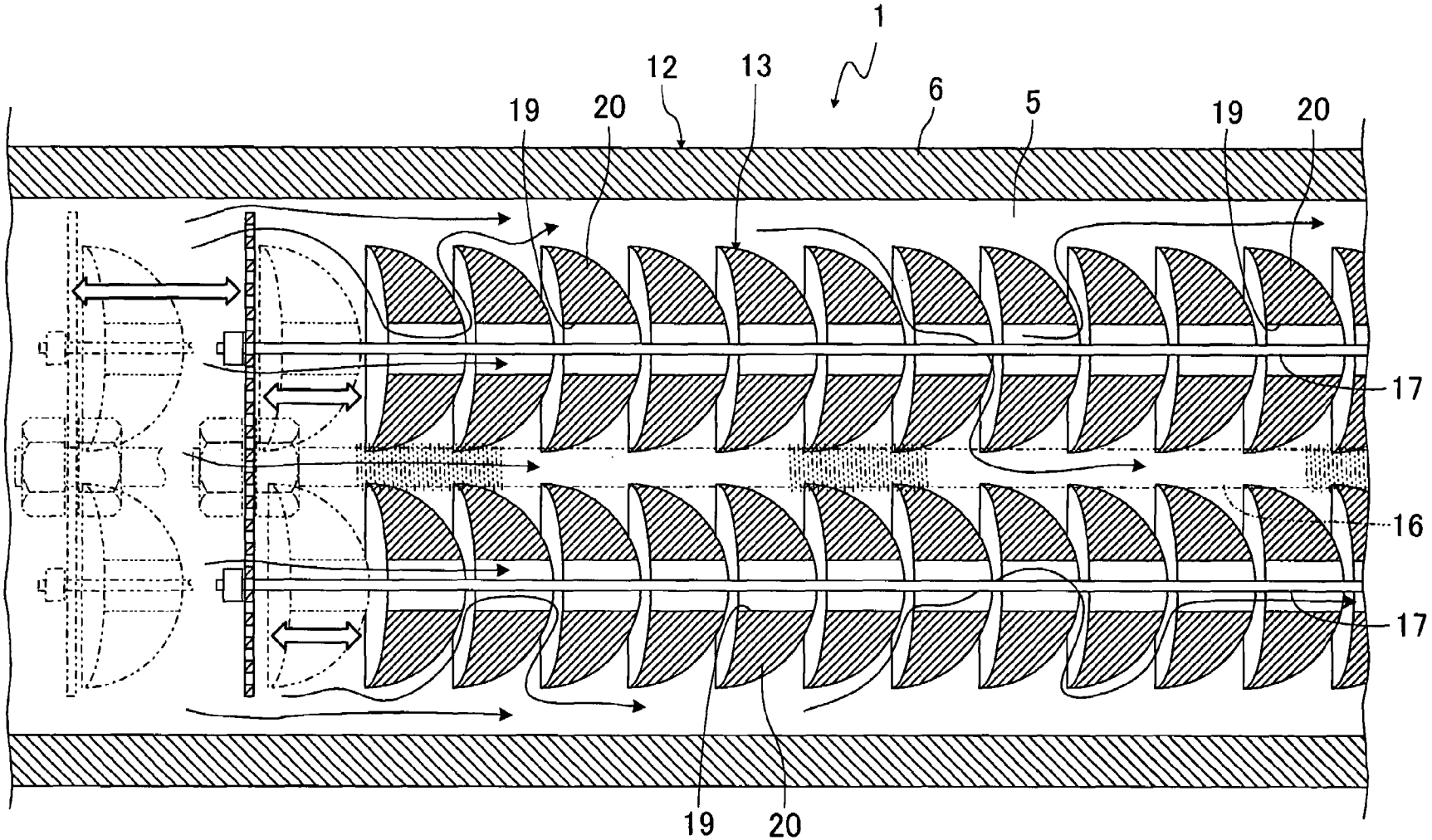
FIG. 8 is an explanation view showing the way in which a liquid fuel is flown in a first embodiment of the present invention.

As shown in FIGS. 6 and 7, the burned object 20 is formed in the shape of the crescent moon in section, and for example, its material and manufacturing method is described below: beaking 25 g of fine powder of diamond chip; 15 g of chromium; 20 g of titanium; 40 g of MYOJIN-ISHI (SEKI); 40 g of hillite; 45 g of Quartz Porphyry; 40 g of silica; 60 g of tourmaline; 10 g of calcium oxide; 10 g of magnesium; 15 g of radium up to super fine powder (4 micrometer) and burning in a furnace at high temperature (1200° C.) in 15 hours, and making fine-broken burned object after breaking the burned object up at fine-broken.

After that, 5 g of gold, 10 g of silver, 5 g of vanadium, 15 g of aluminum, 3 g of iron, 10 g of industrial diamond, 35 g of tin, 5 g of copper, 20 g of manganese, 10 g of tungsten, 5 g of cesium and 15 g of sulfur are broken up to super fine powder (1 micrometer), and the a slight amount of hardening is put in 500 cc of unsaturated polyester resin (U-PICA®); it agitate a mixture; and the agitated object.

After that, the fine-broken burned object and agitated object are put into the pressure cooker, and it is pressured at 10 barometric pressures. When it is heated up at 140° C., it is produced ultrafine adsorbent(caramel solution) and formed in the shape of a crescent moon in section and used. In addition, the U-PICA®-based additive agent is added and mix to titanium and tourmaline-based fine powder of the super fine-broken burned object and cesium-based fine powder, and the burned object 20 is produced after it is pressed and heated. Accordingly, U-PICA® is positioned at the surface of the object so the liquid fuel contacts only U-PICA®. Thereby it can be improved decay resistance at a non-contact state to the other metal.

For the enhancing device 1 for combustion efficiency, when the engine 2 starts, liquid fuel from the fuel tank 3 passes through the fuel-supply pipe 4 and the enhancing device 1 in combustion efficiency and it is supplied into the engine 2.

When liquid fuel passes through the enhancing device in combustion efficiency provided at the fuel-supply pipe 4, liquid fuel which flows from the inputting side of the jointed pipe 9 flows out from the outputting side of the jointed pipe 10 after it passes through the enhancing chamber 5 of the case body 6. Then liquid fuel flown in the enhancing chamber 5 flows between supporting plates 15, 15 from the plurality of the holes 14 of the one supporting plate 15, and it flows at turbulent flow state at the outer circumferential part of the plurality of the burned objects 20 and spaces between the supporting bar 17 and insertion hole 19 of the supporting bar of the burned object 20 in the space between the supporting bodies 15, 15. Thereby, liquid fuel is enhanced to be burned completely in the engine 2 by far-infrared radiation occurred from the burned object 20 and negative ion, and it passes through the plurality of the holes 14 of another supporting plate 15 and supplied in the concave part 8 and is flown out.

Accordingly, fuel is attained complete combustion in the engine 2 so that it can improve the fuel consumption, and emission gas and black smoke can be reduced so as to pass the test in Automobile NOx PM Control law.

Other embodiments of the present invention will now be described referring to FIGS. 9 to 14. Through the drawings of the embodiments, like components are denoted by like numerals as of the first embodiment and will not be further explained in great detail.

Figure 9:
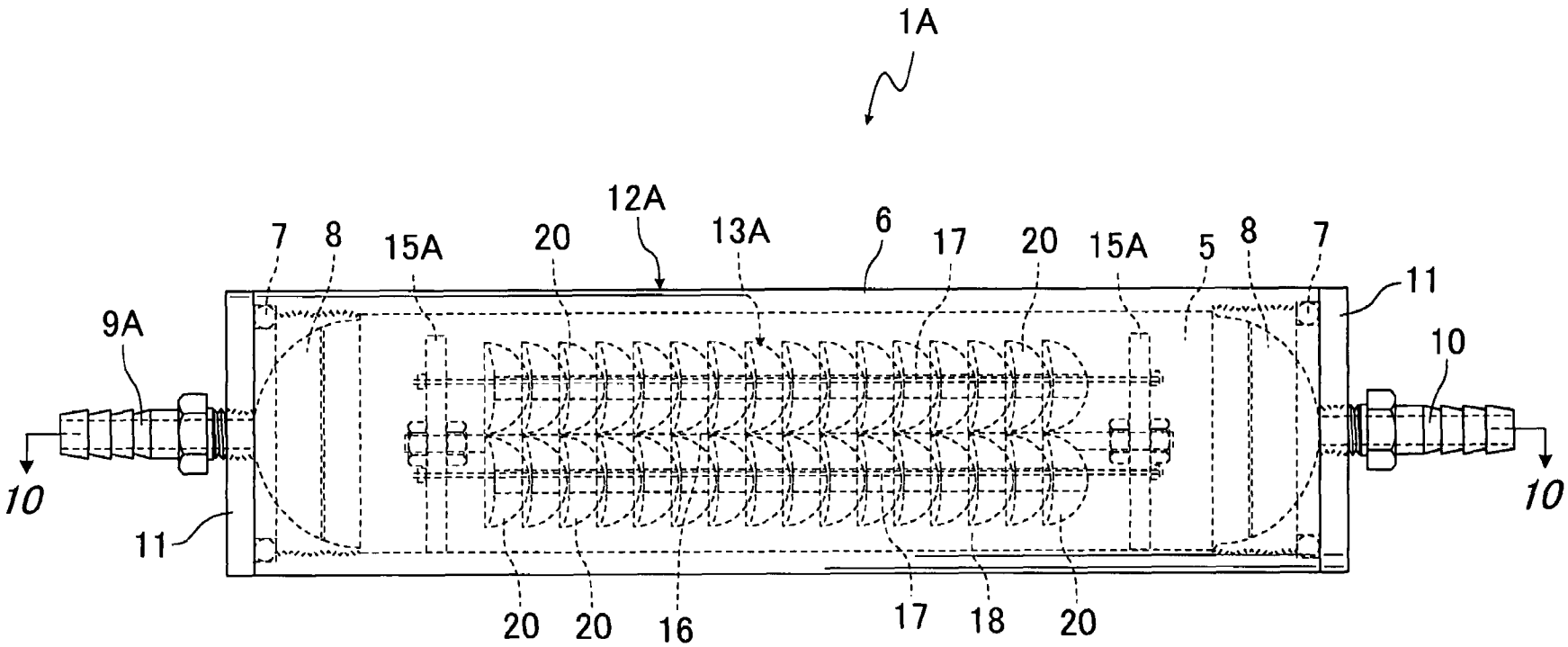
FIG. 9 is a front view showing a second embodiment of the present invention.
Figure 10:
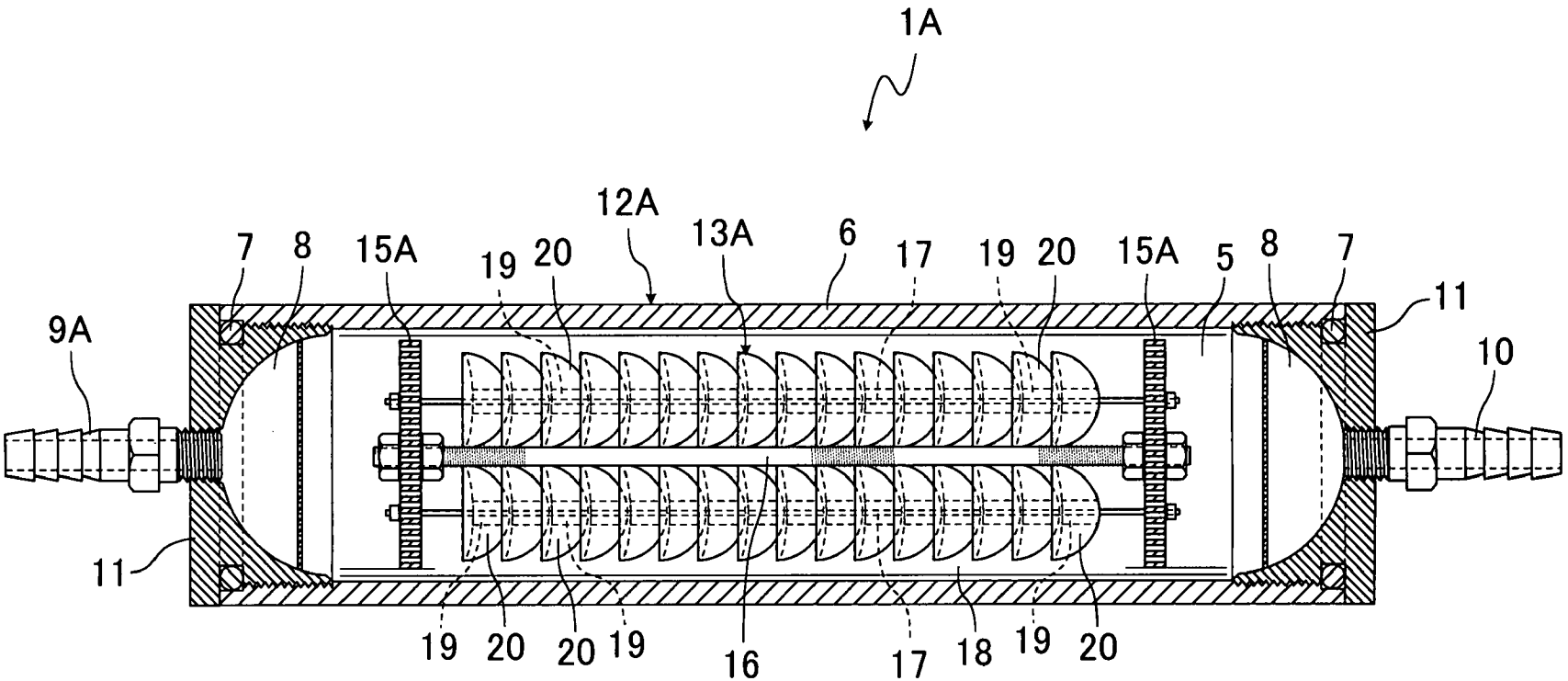
FIG. 10 is a cross sectional view taken along the line 10-10 in FIG. 9.
Figure 11:
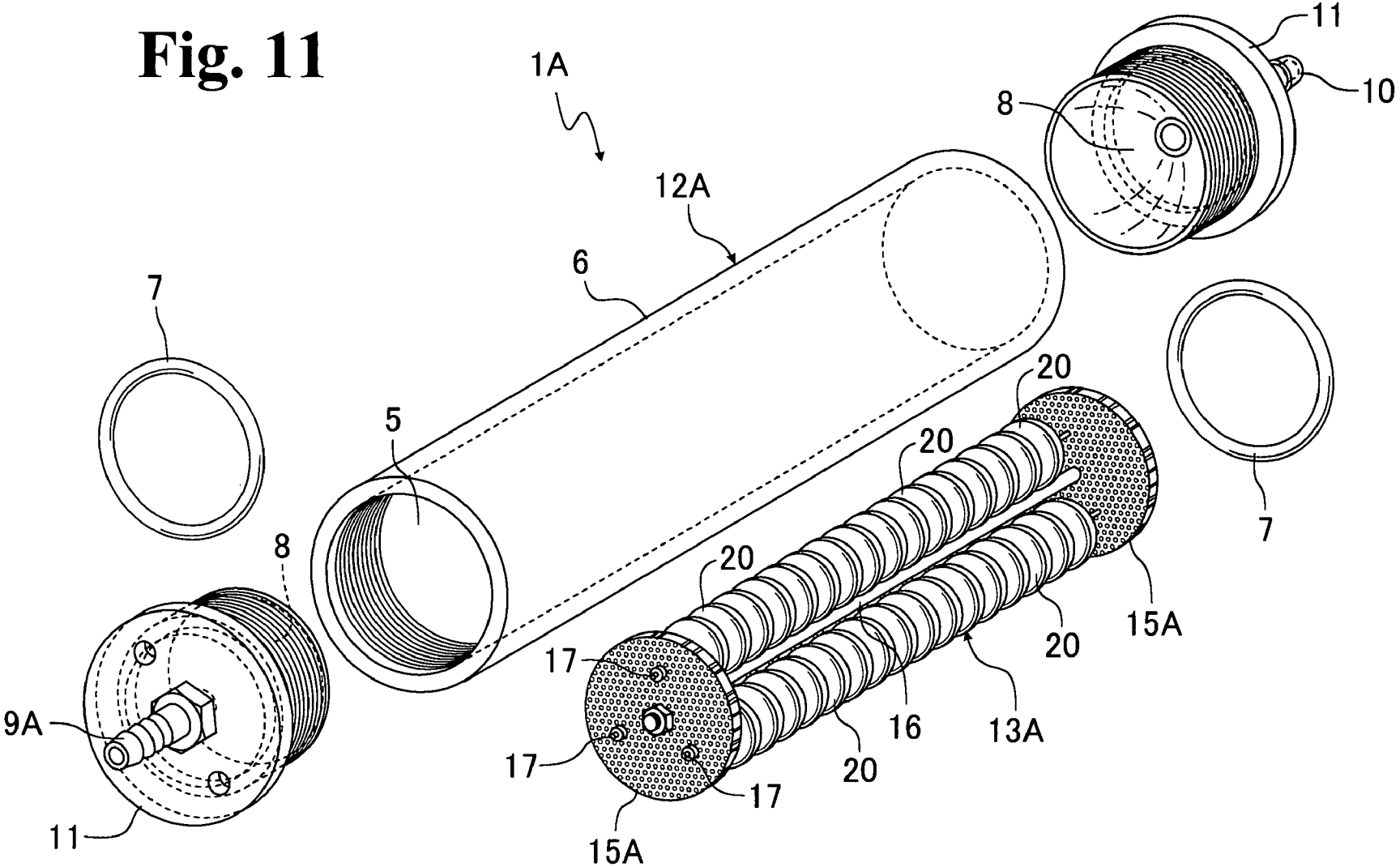
FIG. 11 is an exploded perspective view showing a second embodiment of the present invention.

A second embodiment of the present invention is shown in FIGS. 9 to 11 and is distinguished from the first embodiment by the fact that the case 12 is replaced from another case 12A and the fuel-enhancing unit 13 is replaced from another fuel-enhancing unit 13A. For the case 12A, jointed pipes 9A, 10, which is formed in the shape of a straight, are attached to the blockage body 11, 11 which is fixed to the both ends of the case body 6 at a sealing state. The fuel-enhancing unit 13A includes supporting plates 15A, 15A which are formed the plurality of the holes 14 made of the same material of the burned object 20. An enhancing device for combustion efficiency 1A with the case 12A and the fuel-enhancing unit 13A according to the second embodiment has similar advantages to that according to the first embodiment.

Figure 12:
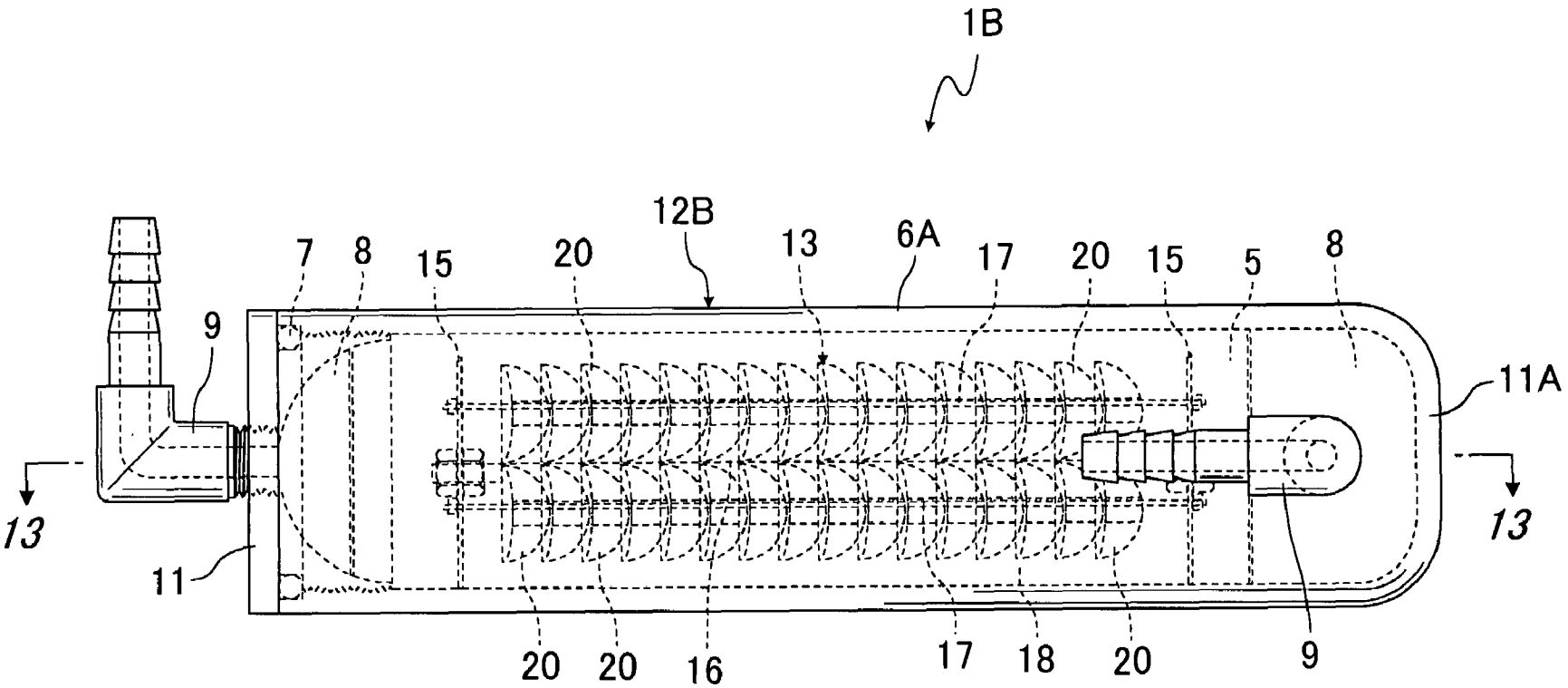
FIG. 12 is a front view showing a third embodiment of the present invention.
Figure 13:
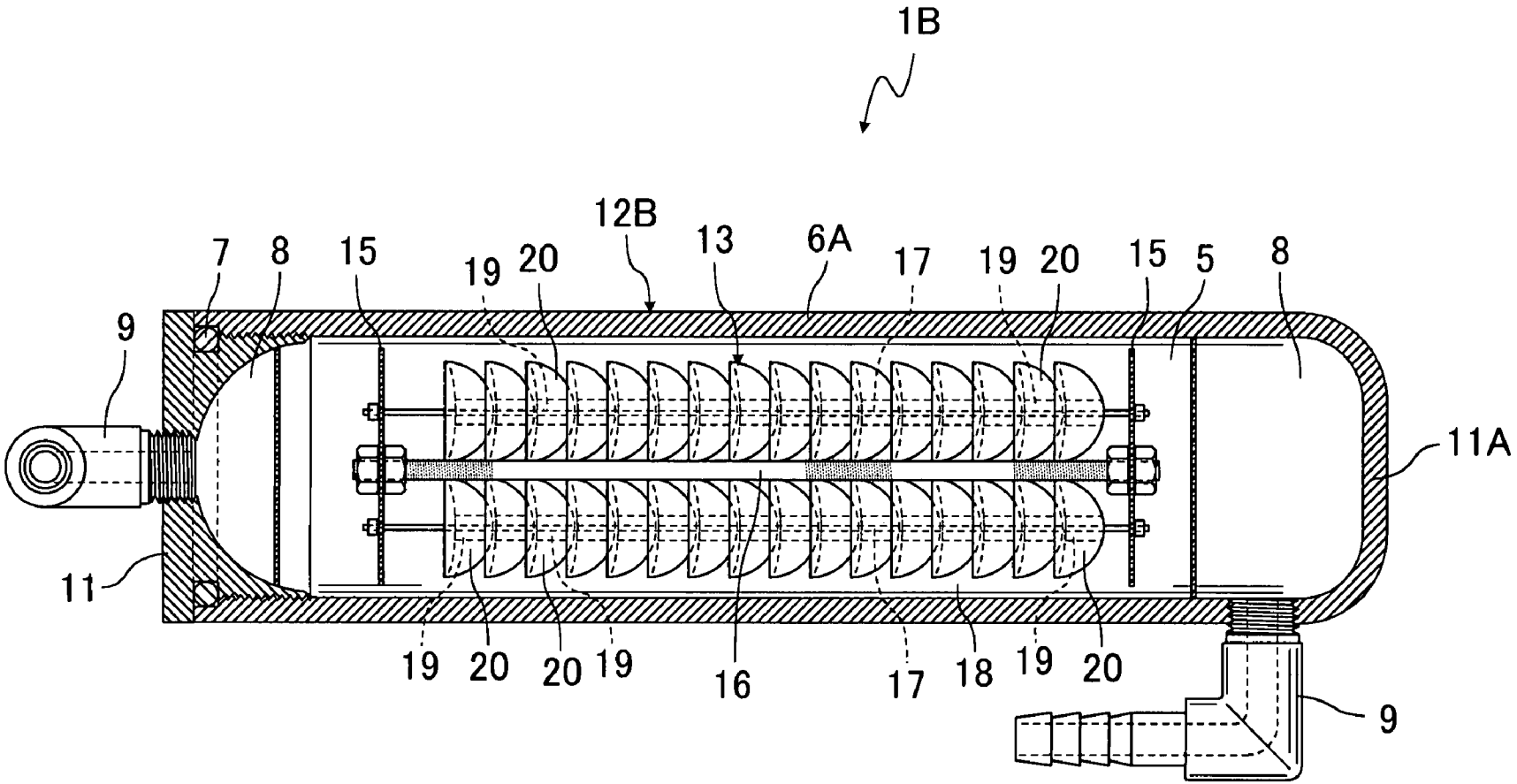
FIG. 13 is a cross sectional view taken along the line 13-13 in FIG. 12.
Figure 14:
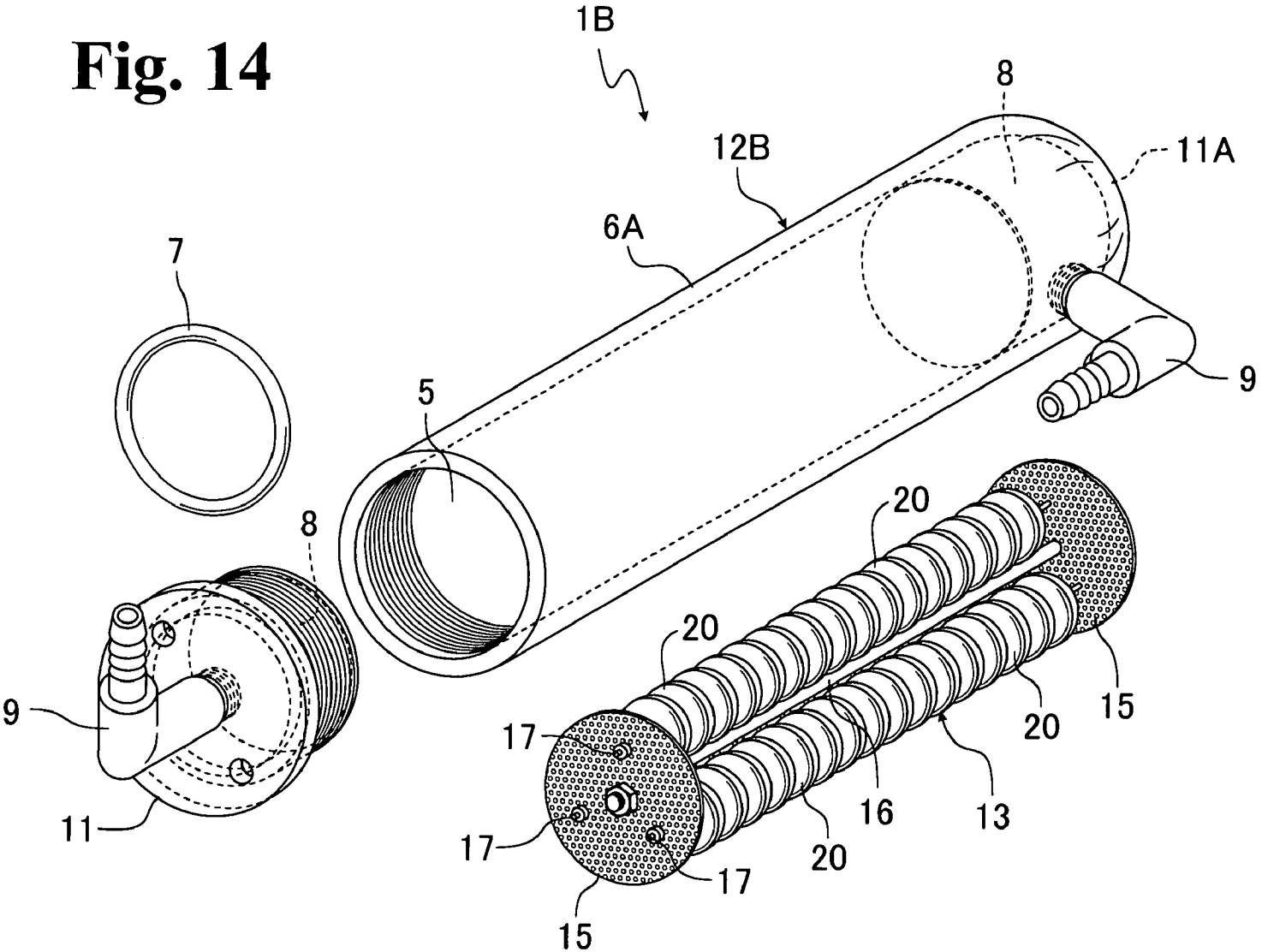
FIG. 14 is an exploded perspective view showing a third embodiment of the present invention.

A third embodiment of the present invention is shown in FIGS. 12 to 14 and is distinguished from the first embodiment by the fact that the case 12 is replaced from another case 12B. One end of a blockage body 1A of a case body 6A is formed integrally or attached fixedly by welding. The jointed pipe 9 is attached to the outer wall surface adjacent one end part of the case 12B. An enhancing device 1 for combustion efficiency 1B according to the second embodiment has similar advantages to that according to the first embodiment.

Additionally, in each embodiment of the present invention, the case is formed in the shape of the cylinder, and it may be formed in the shape of a square, pentagon, and hexagon.

Furthermore, in each embodiment of the present invention, the liquid fuel of fossil fuel is used, and the enhancing device 1 for combustion efficiency has similar advantages when it is used for the engine and combustion device which burns gas fuel of fossil fuel.

As set forth above, the advantages of the invention are as follows:

(1) The device for enhancing combustion efficiency of a fossil fuel includes a case, which is formed in the shape of a cylinder, having an enhancing chamber which has several times an internal diameter of said fuel-supply pipe thereinto, and both ends of the case provided at a sealing state; jointed pipes for inputting and outputting, which are attached to the both ends of the case or portions adjacent the both ends of the case, connecting with the enhancing chamber of the case and fuel-supply pipe; and a fuel-enhancing unit installed into the enhancing chamber of said case, further including a pair of supporting plates which are provided at parts adjacent both ends of the enhancing chamber, forming a plurality of holes; a supporting body attached both ends thereof to a center portion of the supporting plates; a plurality of supporting bars supported both ends thereof by the supporting plates; and a plurality of burned objects provided to each supporting bar, generating far-infrared radiation and negative ion, forming in the shape of a crescent moon in section, forming insertion holes for the supporting bars, corresponding to a size producing an inputting space of the fuel to an outer circumferential part of the supporting bar, generating far-infrared radiation and negative ion. Therefore, it has a long retention time of liquid fuel which passes through enhancing chamber which has several times the internal diameter of the fuel-supply pipe, and it can improve the fossil fuel in efficiency by the fuel-enhancing unit, which is installed into the enhancing chamber using the burned object generating the plurality of far-infrared radiation and negative ion.

Accordingly, fossil fuel which is supplied into the engine and combustion device is supplied after it is improved at the fuel-enhancing unit and attains complete combustion.

Thereby, for the experimental result of the Inventor, it improves 8%~20% of the fuel consumption; it passes the test of the Automobile NOx PM Control law; emission gas including nitrogen oxide, particulate, carbon monoxide, hydrocarbon and carbon dioxide and black smoke can be reduced.

(2) As discussed above, since the plurality of the burned objects are attached to the plurality of the supporting bars, supporting both ends thereof by the pair of the supporting plates, in the enhancing chamber of the case, it flows at turbulent flow state at the outer circumferential part of the plurality of the burned objects and spaces between the supporting bar and insertion hole of the supporting bar when fuel passes through the enhancing chamber so that it can be mixed the negative ion in efficiency.

Accordingly, the improvement of the liquid fuel can be carried out in efficiency equally.

(3) As discussed above, it is only provided to the fuel-supply pipe so that it can be put easily.

(4) claim 2 has the same effect as the above (1) to (3), and fossil fuel which passes through the case can be mixed to the negative ion in efficiency equally.

INDUSTRIAL APPLICABILITY

The present invention is utilized in the industry to manufacture the device for enhancing combustion efficiency.

What is claimed is:

1. A device for enhancing combustion efficiency of a fossil fuel supplied through a fuel-supply pipe to an engine and combustion device, providing the fuel-supply pipe and capable of enhancing the combustion efficiency of the fuel at the engine and combustion device, including:

a case, which is formed in the shape of a cylinder, having an enhancing chamber which has several times an internal diameter of said fuel-supply pipe thereinto, and both ends of said case provided at a sealing state;

jointed pipes for inputting and outputting, which are attached to said both ends of said case or portions adjacent said both ends of said case, connecting with said enhancing chamber of said case and said fuel-supply pipe; and a fuel-enhancing unit installed into said enhancing chamber of said case, further including a pair of supporting plates which are provided at parts adjacent both ends of said enhancing chamber, forming a plurality of holes; a supporting body attached both ends thereof to a center portion of said supporting plates; a plurality of supporting bars supported both ends thereof by said supporting plates; and a plurality of burned objects provided to each supporting bar, generating far-infrared radiation and negative ion, forming in the shape of a crescent moon in section, forming insertion holes for said supporting bars, corresponding to a size producing an inputting space of said fuel to an outer circumferential part of said supporting bar, generating far-infrared radiation and negative ion.

2. A device for enhancing combustion efficiency of a fossil fuel supplied through a fuel-supply pipe to an engine and combustion device, providing the fuel-supply pipe and capable of enhancing the combustion efficiency of the fuel at the engine and combustion device, including:

a case including a case body, which is formed in the shape of a cylinder, having an enhancing chamber which has several times an internal diameter of said fuel-supply pipe thereinto and blockage bodies which are fixed at both ends of said case body at a sealing state, attaching jointed pipes for inputting and outputting, which are formed circular arc-shaped concave parts at an inner wall which is connected to said fuel-supply pipe; and a fuel-enhancing unit installed into said enhancing chamber of said case, further including a pair of supporting plates which are provided movably at parts adjacent both ends of said enhancing chamber, forming a plurality of holes; a supporting body attached both ends thereof to a center portion of said supporting plates; three of four supporting bars supported both ends thereof by said supporting plates at a predetermined space; and a plurality of burned objects provided to each supporting bar, generating far-infrared radiation and negative ion, forming in the shape of a crescent moon in section, forming insertion holes for said supporting bars, corresponding to a size producing an inputting space of said fuel to an outer circumferential part of said supporting bar, providing to be a concave part at a inputting side and generating far-infrared radiation and negative ion.

* * * * *